United States Patent [19]

Uchikoba et al.

[11] 4,070,599

[45] Jan. 24, 1978

[54] MULTI-DIGIT LUMINESCENT DISPLAY TUBE HAVING WIDER GRID FRAME MEMBERS ON BOTH ENDS OF A SERIES OF GRIDS

[75] Inventors: Tsukasa Uchikoba; Saneo Yuda; Kiyoshige Hirano; Kazufumi Yawata; Masaki Kobayakawa, all of Izumi, Japan

[73] Assignee: Nippon Electric Kagoshima, Limited, Izumi, Japan

[21] Appl. No.: 762,485

[22] Filed: Jan. 26, 1977

[30] Foreign Application Priority Data

Jan. 28, 1976 Japan ..... 51-8536

[51] Int. Cl.[2] ..... H01J 1/72; H01J 63/02

[52] U.S. Cl. ..... 313/497; 313/513

[58] Field of Search ..... 313/496, 497, 513

[56] References Cited

U.S. PATENT DOCUMENTS 4,041,348 8/1977 Eto et al. ..... 313/497

*Primary Examiner*—Palmer C. Demeo

[57] ABSTRACT

A multi-digit luminescent display tube comprises a plurality of luminescent anode segment groups. All anode segment groups may be regularly spaced. Alternatively, at least one single anode segment group may be spaced wider from the remaining regularly spaced ones. A grid is interposed between a cathode and each anode segment group and comprises a pair of grid frame members, or rectangular metal rods, transversely of the cathode. Two of the frame members are made wider on both ends of a series of regularly spaced grids than other frame members of the grid series. Both frame members are also made wider for the single anode segment group than the above-mentioned other frame members.

2 Claims, 7 Drawing Figures

MULTI-DIGIT LUMINESCENT DISPLAY TUBE HAVING WIDER GRID FRAME MEMBERS ON BOTH ENDS OF A SERIES OF GRIDS

BACKGROUND OF THE INVENTION

This invention relates to a so-called multi-digit luminescent display tube, such as a fluorescent or phosphorescent display tube, and more particularly to one comprising novel grids.

In a luminescent display tube of this type, there is a multi-unit tube, generally called a multi-digit tube, for displaying a plurality of selected displays, namely, numerals, letters, and/or symbols. The multi-unit tube comprises a plurality of luminescent anode segment groups, a hot cathode or cathodes, a first and a second support for supporting the cathode over the anode segment groups, and a plurality of grid members between the cathode and the respective anode segment groups.

The display tube of the multi-unit type is typically used in an electronic portable calculator in which a large scale integration circuit (an LSI) is frequently adapted for portability of the calculator. Since a circuit is generally operated at low electrical power and low voltage, the display tube which is directly driven by the large scale integration circuit should also luminesce at low voltage and low electrical power.

In the display tube used in the portable calculator, the cathode spends about 75% of the electrical power and, therefore, the consumption of electrical power at the cathode should be improved for low power operation of the display tube. Sophisticated display tubes were supplied with about 90 mA of electrical current per one cathode. A cathode of a recent tube has been supplied with about 11 mA. In other words, the diameter of the cathode has become thin from 31 microns to 8.1 microns. For a thin cathode, the supports have relatively become large in comparison with the cathode. Therefore, both longitudinal end portions of the cathode are excessively cooled due to heat leakage, namely, conduction of heat, at the supports. As a result, the thermal electron emission is lowered at the end portions of the cathode. Consequently, the displays of both end units are apt to be bad in comparison with those of other units.

SUMMARY OF THE INVENTION

It is therefore an object of this invention to provide a luminescent display tube of low rated power wherein the displays of both end units are improved.

It is another object of this invention to provide a luminescent display tube comprising improved grid members aligned at both end units and thereby to compensate luminescing displays at both end units of the tube.

It is a further object of this invention to provide a luminescent display tube comprising a plurality of anode segment groups aligned at regular spaces, a single additional anode segment group spaced apart from the first mentioned groups wherein the displays are improved both at the additional group and the end ones of regularly spaced groups.

A luminescent display tube for displaying luminescing displays of a plurality of units substantially at a time comprises a plurality of anode segment groups regularly spaced along a line segment, a hot cathode, a first and a second support on both longitudinal sides of the line segment for supporting the cathode over the anode segment groups substantially parallel to the line segment, and a plurality of grid members between the cathode and the respective anode segment groups. Each of the anode segment groups comprises a plurality of segmented luminescent anodes for a concerned one of the displays. Each of the grid members comprises a first and a second metal member transversely of the line segment and a metal mesh supported by the metal members, where the respective first metal members are nearer to the first support than the second metal members while the second metal members are nearer to the second support than the first metal members. In accordance with this invention, the first metal member for the anode segment group nearest of the anode segment groups to the first support and the second metal member of the anode segment group nearest of the anode segment groups to the second support are wider in a direction of the line segment than all other metal members for the anode segment groups.

DESCRIPTION OF THE PREFERRED EMBODIMENTS

Figure 1:
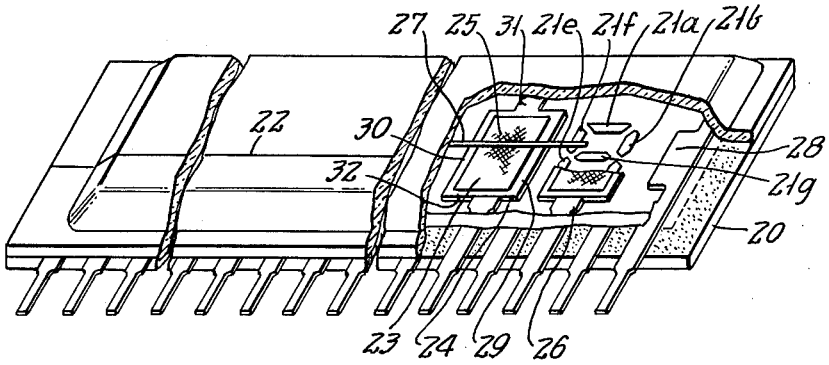
FIG. 1 is a perspective view of a general luminescent display tube.

Referring to FIG. 1, a luminescent display tube comprises a substrate 20 of an electrically insulating material, such as glass or ceramics, and a plurality of luminescent anode segment groups 21 comprising a plurality of segmented luminescent anodes **21*a*–21*g* on the substrate 20. The anode segment groups 21 are regularly spaced along a line segment 22, namely, a straight line of a finite length. In the example being illustrated, the segmented luminescent anodes, or anode segments, 21*a*–21*g* each anode segment group 21 are arranged in a substantially figure-of-eight configuration and display a selected one of the numerals 0 to 9. A plurality of grid members 23 are assigned to the respective anode segment groups 21. Each of the grid members 23 comprises a frame piece 24 of a substantially rectangular contour, a metal mesh 25 supported by the frame piece 24, and a spacer 26 connected to the frame piece 24 in order to supply grid voltage. The luminescent display tube further comprises a hot cathode 27 and a first support 28 and a second support (not shown) on both longitudinal sides of the line segment 22 for supporting the cathode 27 over the anode segment groups 21. Each of the frame piece 24 for each anode segment 21 comprises a first and a second metal members 29 and 30 intersecting the line segment 22 and a pair of metal members 31 and 32 parallel with the line segment 22. The first metal members 29 for the anode segment groups 21 are nearer to the first support 28 than the second metal members 30 for the anode segment groups 21**.

As is known in the art, anode currents bombarding a luminescent layer on the anode segments 21*a*–21*g* should be increased to display sufficient luminescing displays at a low rated voltage. That is, it is necessary to enlarge the perveance of a luminescent display tube. Therefore, the gap between the cathode 27 and the grid members 24 is narrowly designed in usual. But, in this type of the display tube, the distances from each of anode segments 21*a*–21*g* of the respective anode segment groups 21 to the cathode 27 are very unequal because of a narrow gap. Consequently, the displays of both end units nearest to supports, such as 28, are dark due to the lack of electron emission of the cathode 27 at end portions thereof and to the unevenness of the perveance.

Figure 2:
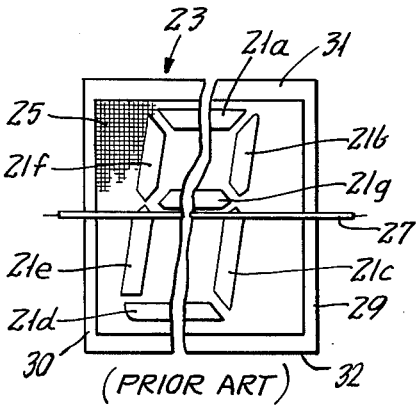
FIG. 2 is an enlarged fragmentary plan of a conventional display tube.

Referring to FIG. 2, description will be made of conventional grid members 23 for a better understanding of this invention. Each grid member 23 is supported between a plurality of anode segments 21*a*–21*g* of each anode segment group and a cathode 27. Further, an upper and a lower metal 31 and 32 of a frame piece 24 are parallel with the cathode 27 and anode segments 21*a*, 21*d* and 21*g*. That is, the distances between the cathode 27 and the anode segments 21*a* and 21*d* are substantially constant at each anode segment group and, moreover, the shield effect of space charges due to a current flow in the upper and lower members 31 and 32 to the anode segments 21*a* and 21*d* are substantially uniform thereat. Therefore, the luminescing displays of the anode segments 21*a* and 21*d* are comparatively uniform in each segment group.

However, each perveance between each of the anode segments 21*b*, *c*, *e*, and *f* and the cathode 27 are not uniform because the distances from the cathode 27 to each of the anode segments are different. Especially, a luminescing intensity at both end units is poorer than the intensity at the other units.

Figure 3:
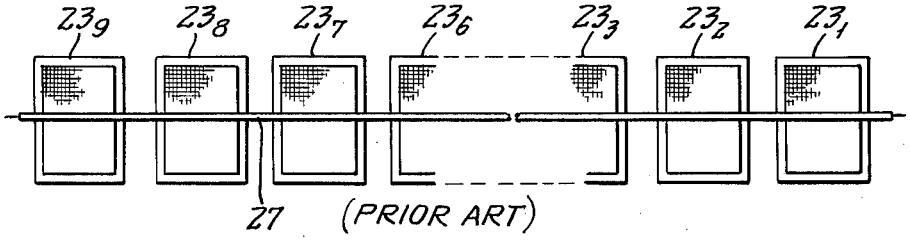
FIG. 3 shows an arrangement of grid members of a conventional display tube.

Referring to FIG. 3, there is shown a conventional arrangement of a plurality of grid members $23_1$ to $23_9$. Since all of the grid members have the same constructure, the reduction of the luminescing intensity and the unevenness of displays are inevitable at anode segment groups for both end units of the grid members $23_1$ and $23_9$. To compensate luminescing displays at end units, it has been tried to enlarge a distance between a support and an end portion of a frame piece, such as 24, nearest to the support. An alternative is to provide two parallel cathodes.

Figure 4:
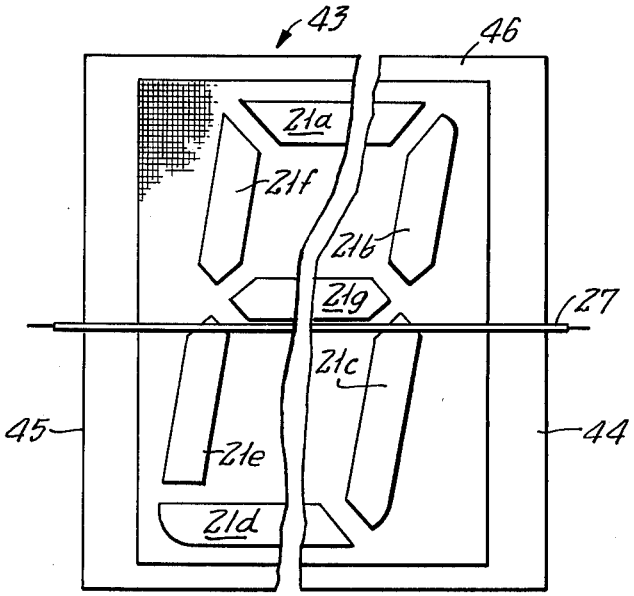
FIG. 4 is an enlarged fragmentary plan of a display tube according to a preferred embodiment of this invention.

Referring now to FIG. 4, grid member 43 nearest to the cathode supports (not shown in FIG. 4) in a luminescent display tube according to a preferred embodiment of this invention comprises a first and a second metal members 44 and 45 which are wider in a direction of the cathode 27 than those of the other grid members (not shown in FIG. 4) at the other units and than upper and lower members 46 and 47. With the grid members 43 having wide metal members, a distribution of current is different from other grid members so that this configuration of the grid members 43 serves to derive thermoelectrons from the cathode 27 as well as to effectively shield parasitic space charges. Thus, anode currents are uniformly supplied for anode segments 21*b* and 21*d* by this grid member 43 and uniform displays of such segments are accomplished thereby.

Figure 5:
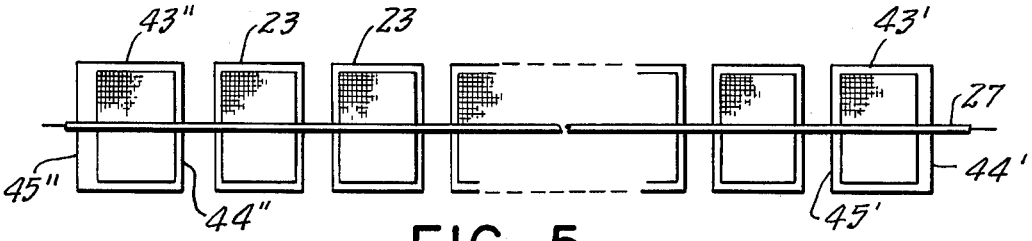
FIG. 5 shows an arrangement of grid members according to a first embodiment of this invention.

Referring to FIG. 5, an arrangement of a plurality of grid members according to a first embodiment of this invention comprises a plurality of grid members 23, 43', and 43" regularly spaced along the cathode 27 for the respective anode segment groups. It is noted that the first and second metal members 44' and 45" of the respective grid members 43' and 43" nearest to a first and a second support (not shown in FIG. 5) are wider than the corresponding metal members of the other grid members 23 in the configuration of frame pieces. More particularly, the grid member 43' comprises a first and a second metal members 44' and 45', wherein the first metal member 44' is nearer to the first support than the second metal member 45'. In the grid member 43", the second metal member 45" is nearer to the second support than the first one 44". In this embodiment, the first metal member 44' near to the first support and the second metal member 45" near to the second support are wider in a direction of the cathode 27 than those of all other grid members 23 in order to compensate luminescing displays at end units.

Figure 6:
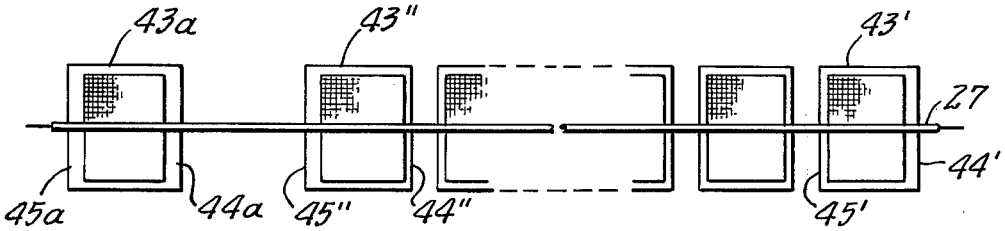
FIG. 6 shows an arrangement of grid members according to a second embodiment of this invention.

Referring to FIG. 6, there is provided a plurality of grid members 43', 23, and 43" regularly spaced along the cathode 27 and a single additional grid member 43*a*. The additional grid member 43*a* is arranged between the second support and the grid member 43" at an end unit of a series of grid members 43', 23, and 43" and spaced wider in a direction of the cathode 27 from the regularly spaced grid members. Further, both of the first and second metal members 44*a* and 45*a* of the additional grid member are substantially as wide in the direction of the cathode 27 as the metal members 44' and 45" of the end grid members 43' and 43" wider than other metal members.

Figure 7:
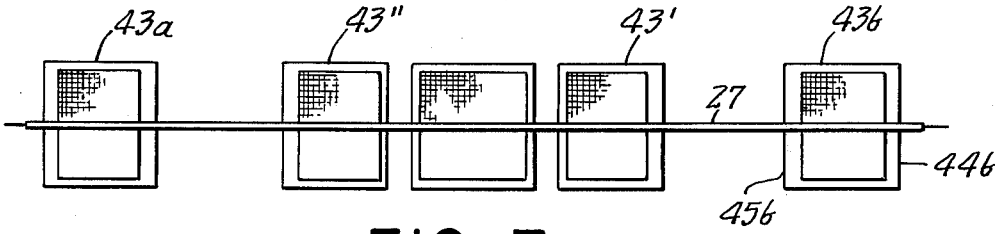
FIG. 7 shows an arrangement of grid members according to a third embodiment of this invention.

Referring to FIG. 7, another additional grid member 43*b* is also provided between the first support and an end grid member 43' for an anode segment group besides the additional grid member 43*a*, and spaced wider from the regularly spaced grid members 23. Both metal members 44*b* and 45*b* of the additional grid member 43*b* are wider in the direction of the cathode 27 than those of the grid members 23.

Thus, when there is an additional grid member separated from a series of regularly spaced grid members, both sides of the series and the additional grid member are rendered wider than other grid members within the series so as to uniformly shield excessive parasitic space charges within a wide space.

The widths of first and second metal members are dependent on anode segment sizes and working voltages. For example, in a display tube wherein the rating of an anode voltage and a grid voltage is 24 volt at peak-peak value, the heights of anode segments are 5 mm, and the spacing between units are 5 mm, the widths of metal members are changed from 0.25 mm to 0.7 mm to obtain sufficiently luminescing displays.

The grid mesh 25 or the above-mentioned grid member, such as 23, may be attached onto a frame shaped spacer, mentioned also hereinabove, or to a spacer arrangement comprising spacer members transversely of the cathode 27. In this event, the spacer members are equivalent to the first and second grid metal members.

While a few preferred embodiments of this invention have thus far been described, it is to be understood that this invention is applicable to a luminescent display tube of a different type provided that the tubes comprises a pair of grid metal members transversely of the cathode 27. For example, the tube may comprise the substrate 20 sealed in a glass bulb together with the electrodes 21, 23, and 27. Each grid member, such as 23, may not be rectangular in shape but may be a parallelogram in outline. The tube may comprise a single additional anode segment group between two adjacent regularly spaced anode segment groups and spaced wider from the two than the regularly spaced anode segment groups.

What is claimed is:

1. In a luminescent display tube for displaying luminescing displays of a plurality of units substantially at a time, comprising a plurality of anode segment groups regularly spaced along a line segment, a hot cathode, a first and a second support on both longitudinal sides of said line segment for supporting said cathode over said anode segment groups substantially parallel to said line segment, a first and a second metal member for each anode segment group transversely of said line segment, and metal meshes supported by the metal members for said anode segment groups between said cathode and the respective anode segment groups, each of said anode segment groups comprising a plurality of segmented luminescent anodes for the displays of a concerned one of said units, the first metal members for said anode segment groups being nearer to said first support than the second metal members for said anode segment groups, the improvement wherein the first metal member for the anode segment group nearest of said anode segment groups to said first support and the second metal member of the anode segment group nearest of said anode segment groups to said second support are wider in a direction of said line segment than all other metal members for said anode segment groups.

2. A luminescent display tube as claimed in claim 1, further comprising a single additional anode segment group between said line segment and said first support, a pair of metal members on both sides along said direction of said additional anode segment group, and a metal mesh supported by the metal members of said pair between said cathode and said additional anode segment group, said cathode being supported by said supports also over said additional anode segment group, said additional anode segment group comprising a plurality of segmented luminescent anodes for the displays of a pertinent one of said units and spaced wider in said direction from the regularly spaced anode segment groups than the regular spacing of said regularly spaced anode segment groups, wherein the metal members of said pair are wider in said direction than said all other metal members.

* * * * *